US007666802B2

(12) United States Patent
Capwell

(10) Patent No.: US 7,666,802 B2
(45) Date of Patent: Feb. 23, 2010

(54) BREATHABLE, FIRE RESISTANT FABRIC HAVING LIQUID BARRIER AND WATER-REPELLANT PROPERTIES

(75) Inventor: David A. Capwell, West Greenwich, RI (US)

(73) Assignee: Brookwood Companies, Inc., New York, NY (US)

( * ) Notice: Subject to any disclaimer, the term of this patent is extended or adjusted under 35 U.S.C. 154(b) by 0 days.

(21) Appl. No.: 12/353,486

(22) Filed: Jan. 14, 2009

(65) Prior Publication Data

US 2009/0181588 A1 Jul. 16, 2009

Related U.S. Application Data

(60) Provisional application No. 61/021,160, filed on Jan. 15, 2008.

(51) Int. Cl.
*B05D 1/38* (2006.01)

(52) U.S. Cl. ..... 442/136; 427/393.3

(58) Field of Classification Search ..... 442/64, 442/65, 71, 74, 76, 79, 80, 81, 82, 91, 92, 442/136, 139, 146; 427/393.3, 240, 365
See application file for complete search history.

(56) References Cited

U.S. PATENT DOCUMENTS

| | | | |
|---|---|---|---|
| 3,912,792 | A | 10/1975 | Touval |
| 3,944,688 | A | 3/1976 | Inman |
| 4,147,678 | A | 4/1979 | Mao et al. |
| 4,284,682 | A | 8/1981 | Tschirch et al. |
| 4,395,511 | A | 7/1983 | Tschirch et al. |
| 4,525,516 | A | 6/1985 | Garcia et al. |
| 5,150,476 | A | 9/1992 | Statham et al. |
| 5,464,919 | A | 11/1995 | Sinclair |
| 5,527,597 | A | 6/1996 | Stanhope et al. |
| 5,556,903 | A | 9/1996 | Green |
| 5,694,981 | A | 12/1997 | Stanhope et al. |
| 5,727,401 | A | 3/1998 | Statham |
| 5,899,783 | A | 5/1999 | Kimbrell, Jr. et al. |
| 5,912,196 | A | 6/1999 | Radwanski et al. |
| 5,928,971 | A | 7/1999 | Ellis et al. |
| 6,042,639 | A | 3/2000 | Valsö et al. |
| 6,132,476 | A | 10/2000 | Lunsford et al. |
| 6,136,730 | A | 10/2000 | Kimbrell, Jr. et al. |
| 6,541,402 | B1 | 4/2003 | Kimbrell, Jr. et al. |
| 6,547,835 | B1 | 4/2003 | Lunsford et al. |
| 6,699,805 | B2 | 3/2004 | Truesdale, III |
| 6,713,411 | B2 | 3/2004 | Cox et al. |
| 6,735,789 | B2 | 5/2004 | Kelleher et al. |
| 6,818,024 | B2 | 11/2004 | Lunsford et al. |
| 6,833,335 | B2 | 12/2004 | DeMott et al. |
| 6,840,967 | B1 | 1/2005 | Riggins et al. |
| 6,842,967 | B2 | 1/2005 | Wingeier |
| 6,867,154 | B1 | 3/2005 | Lunsford et al. |

(Continued)

*Primary Examiner*—Arti Singh-Pandey
(74) *Attorney, Agent, or Firm*—Alston & Bird LLP

(57) ABSTRACT

The present invention is directed to a fabric composed of nylon or polyester fibers and having both liquid barrier properties and fire retardant properties without sacrificing many of the desirable properties of the fabric. In particular, the present invention helps overcome many of the disadvantages associated with prior art fabrics by providing a fabric having feel and drape of a textile fabric while having good fluid barrier characteristics and fire retardant characteristics. In one embodiment, the invention is also directed to a breathable nylon or polyester fabric having liquid barrier and fire retardant properties. The present invention also provides methods of making such fabrics.

20 Claims, 1 Drawing Sheet

U.S. PATENT DOCUMENTS

Figure 1:
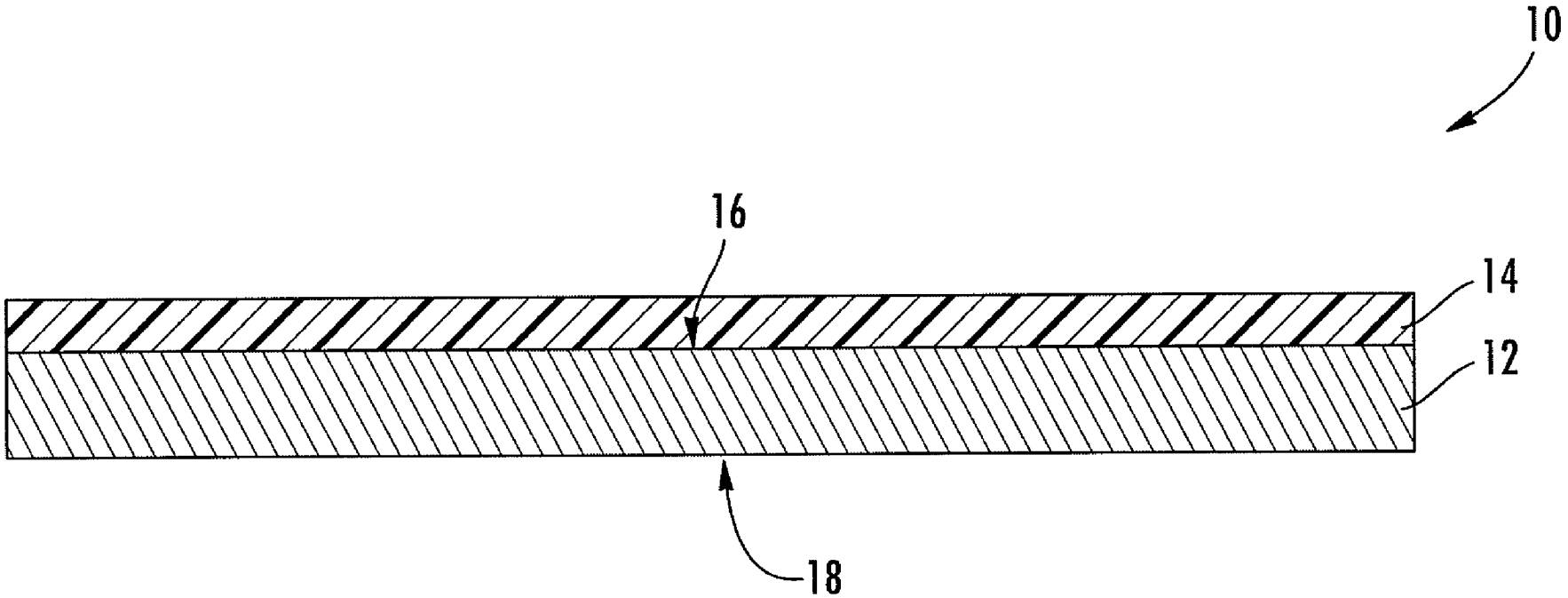

| | | | |
|---|---|---|---|
| 6,869,900 | B2 | 3/2005 | Wyner et al. |
| 7,013,496 | B2 | 3/2006 | Dunn |
| 7,084,196 | B2 | 8/2006 | Troutman et al. |
| 7,129,291 | B2 | 10/2006 | Blount |
| 7,211,293 | B2 | 5/2007 | Piana et al. |
| 7,393,800 | B2 | 7/2008 | Corner |
| 2002/0019183 | A1 | 2/2002 | Demott et al. |
| 2002/0061949 | A1 | 5/2002 | Wang et al. |
| 2003/0228812 | A1 | 12/2003 | Stanhope et al. |
| 2004/0063371 | A1 | 4/2004 | Cox et al. |
| 2004/0092184 | A1 | 5/2004 | Kingman |
| 2004/0152378 | A1 | 8/2004 | Stanhope et al. |
| 2005/0059754 | A1 | 3/2005 | Lunt et al. |
| 2006/0030228 | A1 | 2/2006 | Truesdale et al. |
| 2006/0040575 | A1 | 2/2006 | Kelleher et al. |
| 2006/0059634 | A1 | 3/2006 | Tutterow |
| 2006/0084337 | A1 | 4/2006 | Corner et al. |
| 2006/0089069 | A1 | 4/2006 | Allen, II et al. |
| 2007/0123127 | A1 | 5/2007 | Hirschmann, Jr. et al. |
| 2007/0184737 | A1 | 8/2007 | Corner et al. |
| 2007/0231573 | A1 | 10/2007 | Thatcher |
| 2008/0057807 | A1 | 3/2008 | Tutterow et al. |
| 2008/0086798 | A1 | 4/2008 | Allen, II et al. |
| 2008/0148468 | A1 | 6/2008 | Laton et al. |
| 2008/0152888 | A1 | 6/2008 | Tutterow et al. |
| 2008/0153372 | A1 | 6/2008 | Truesdale et al. |
| 2008/0176065 | A1 | 7/2008 | Hirschmann et al. |

BREATHABLE, FIRE RESISTANT FABRIC HAVING LIQUID BARRIER AND WATER-REPELLANT PROPERTIES

CROSS REFERENCE TO RELATED APPLICATIONS

This application is related to commonly owned Provisional Application Ser. No. 61/021,160, filed Jan. 15, 2008, incorporated herein by reference in its entirety, and claims the benefit of its earlier filing date under 35 U.S.C. 119(e).

FIELD OF THE INVENTION

The present invention is directed to fire resistant fabrics, and more particularly to nylon and polyester fire resistant fabrics.

BACKGROUND OF THE INVENTION

Fabrics formed from polyester or nylon fibers have many useful properties including low cost, manufacturability, relatively light weight, dyeability, and wearability, to name but a few. Due to these useful properties, such fabrics have found wide spread use in garment applications. In particular, nylon and polyester fabrics are often used in the manufacture of outer protective garments such as jackets, pants, hats, gloves, and the like.

In such applications, it is also desirable for the fabric to include liquid barrier properties to help prevent liquids, such as water, from penetrating through the garment and contacting the skin of the wearer. Generally, liquid barrier properties can be imparted to a fabric by coating it with a urethane coating or water-repellant composition, such as a fluorochemical, which helps prevent water from penetrating into the fabric.

In some cases, it may also be desirable for the fabric to have fire resistant properties. Various fire retardant compositions and approaches have developed that can be applied to fabrics to help improve the fire resistance of the fabric to which it is applied. Generally, these compositions and approaches involve the chemical or physical application of a protective coating on the surface of the fabric. These fire retardant compositions are typically applied to the fabric in at a relatively high concentration in order to obtain the desired fire retardant properties in the fabric. Many such fire retardant compositions do not work adequately with respect to polyester and nylon fibers. Many common fire retardant compositions use a self-extinguishing process after ignition to thereby prevent further ignition of the fabric and the fibers themselves. However, polyester and nylons fibers generally melt before actual ignition of the fibers occurs. As a result, the fibers may melt prior to ignition of the flame retardant compositions. This can result in melted material from the fibers contacting the skin of the wearer, which in turn can result in burning the wearer's skin.

In some cases, coating the fabric with a flame retardant composition can reduce the otherwise desirable properties of the fabric, for example, the wearability, weight, and/or flexibility of the fabric. This loss of desirable properties may be particularly amplified in cases where a fabric is treated with both a fire retardant composition and a water repellant composition. Additionally, the application of both a fire retardant composition and a water repellant composition may result in loss or a decrease in the breathability of the fabric. Breathability in barrier fabrics may be desirable because it allows moisture vapor to egress out of the garment while preventing liquids from ingressing into the fabric.

BRIEF SUMMARY OF THE INVENTION

The present invention is directed to a fabric composed of nylon or polyester fibers and having both liquid barrier properties and fire retardant properties without sacrificing many of the desirable properties of the fabric. In particular, the present invention helps overcome many of the disadvantages associated with prior art fabrics by providing a fabric having feel and drape of a textile fabric while having good fluid barrier characteristics and fire retardant characteristics. In one embodiment, the invention is also directed to a breathable nylon or polyester fabric having liquid barrier and fire retardant properties. The present invention also provides methods of making such fabrics.

In one embodiment, the present invention is directed to a fire resistant woven fabric formed of polyester or nylons fibers in which a fluid saturant impregnates the fabric and covers the surfaces of the fibers, and in which a layer of fire resistant polyurethane covers at least one surface of the fabric substrate. The fluid saturant can comprise a fire resistant polymer and an oil and water repellent composition, such as a combination of fluoroalkyl acrylate copolymer and thiourea formaldehyde.

The polyurethane coating comprises polyurethane; a thermally degradable aromatic halogen containing compound; an antimony oxide or barium metaborate monohydrate; and a metal hydroxide or mineral hydride. In one embodiment, the polyurethane coating comprises about 35 to 40 wt. % polyurethane; about 15 to 20 wt. % of decabromodiphenyl ether or ethylene-bis-tetrabromophthalimide; about 4 to 5 wt. % barium metaborate monohydrate; and about 4 to 5 wt. % aluminum hydroxide.

The present invention can also be used to prepare fabrics for use in breathable applications. For example, the fabric can have a moisture vapor transmission rate of at least 600 $g/m^2$/day and a hydrohead of at least 30 cm.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 is a cross-sectional side view of a fire resistant fabric that is in accordance with the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 is a cross-sectional side view of a multilayer protective fabric 10 that is in accordance with one embodiment of the present invention. Fabric 10 comprises a textile laminate having a fabric substrate layer 12 composed of nylon or polyester fibers, and a fire retardant coating layer 14 applied to at least one of the surfaces 16, 18 of the fabric substrate 12. As discussed in greater detail below, the fabric substrate 12 is impregnated with a composition that includes both a fire retardant oligimer and a water and oil repellant compound to provide the fabric substrate with improve fire retardant characteristics as well as resistance to the penetration of water and oil into the fabric substrate. The fire retardant coating 14 comprises a polyurethane film that includes a combination of fire retardant compounds that help provide the fire retardant coating 14 with fire retardant characteristics as well as liquid barrier properties. The polyurethane film generally defines an inner surface of the protective fabric 10 and provides liquid barrier properties to the fabric as well.

Generally, the fabric substrate is a woven fabric composed of a plurality of interwoven fibers. For example, in one embodiment, the present invention is directed to a protective fabric having a woven fabric substrate to which a fire retardant coating layer has been applied. However, it should be recognized that in some embodiments the fabric substrate can be composed of other types of textile fabrics, such as non-woven or knit fabrics, provided the desired properties of the protective fabric can be obtained. Unless otherwise stated, the term "fiber" is used in a generic sense, and can include yarns, fibers, filaments, and the like.

The fabric substrate is composed of polyester fibers, nylon fibers, or a combination thereof. Suitable polyester polymers that can be used in the practice of the invention include polyethylene terephthalate, polybutylene terephthalate, and combinations thereof. Suitable nylon polymers that can be used in the practice of the invention include Nylon 6, Nylon 6,6, Nylon 11, Nylon 12, Nylon 6, 10, MXDX Nylon, and copolymers and combinations thereof.

As briefly noted above, the fabric substrate 12 is impregnated with a composition that includes both a fire retardant oligimer and a water and oil repellant compound. In one embodiment, this composition (i.e., fire retardant oligimer with water and oil repellant compound) is applied to the fabric substrate 12 as a finish coating or fluid saturant. Typically, the fluid saturant can be applied to the fabric substrate as a fluid that impregnates the fabric substrate and coats the surfaces of the fibers. In one embodiment, the fire retardant oligomer serves as a carrier for the water and oil repellant composition. Suitable fire retardant oligimers that can be used in the practice of the invention include thiourea formaldehyde and organophosphate oligomers. An exemplary organophosphate that can be used in the practice of the invention is a phosphate ester blend that is available from Manufacturers Chemicals LP under the tradename Fire Retard 66. Suitable water and oil repellant compounds that can be used in the practice of the invention include fluorochemicals, polysiloxanes and the like. Fluoroalkyl acrylate copolymer is an exemplary fluorochemical that can be used in the practice of the invention.

In one embodiment, the fluid saturant (i.e., fire retardant oligimer with water and oil repellant compound) includes an organic catalyst, such as para-toluene sulfonic acid. The organic catalyst reacts with the thiourea-formaldehyde adduct in the finish to form a thiourea aminoplast. The thiourea aminoplast is relatively insoluble and helps to improve the durability of the flame resistant properties of the fabric.

The composition comprising the fire retardant oligimer and a water and oil repellant compound can be applied to the fabric substrate by immersion coating, spraying, foam application, kiss-coat, and the like. In one particular embodiment, the composition can be applied by passing the fabric substrate through a bath of the composition for a time sufficient for the composition to substantially impregnate the fabric substrate. The amount of the fire retardant oligomer in the bath is typically from about 5 to 50 wt. %, and more typically from about 15 to 30 wt. %. The amount of the water and oil repellant compound in the aqueous bath is typically from about 0.75 to 5 wt. %, and more typically from about 1.5 to 3 wt. %.

Generally, the amount of the composition containing the fire retardant oligimer and the water and oil repellant compound that is applied to the fabric substrate is from about 20 to 50 wt. %, based on the total weight of the fabric, and in particular from about 20 to 40 wt. %, and more particularly, from about 25 to 30 wt. %, based on the total weight of the fabric substrate. Desirably, the fluid saturant is added to the fabric substrate at a weight of about 0.05-1 ounces per square yard of material.

Once the fabric has been impregnated with the fluid containing the fire retardant oligimer and a water and oil repellant compound, the fabric is then heated to dry and cure the composition onto the surface of the fibers. In one embodiment, the impregnated fabric is passed through an oven at a temperature from about 150° to 400° F. at a speed that typically ranges between 1 and 50 yards per minute.

In a further embodiment, the fabric substrate can be impregnated with a nanoparticle based fluid saturant. In this embodiment, the fluid saturant comprises about 2 to 10 wt. % of a fluoroalkyl acrylate copolymer; 3 to 8 wt. % of an amorphous silica having an average particle size of about 20 to 60 nm; about 1 to 3 wt. % tripropylene glycol; and balance water. In one particular embodiment, the fluid saturant has the following composition: about 6 wt. % fluoroacrylate and alkylacrylate copolymers; about 5 wt. % amorphous silica particles having an average particle size of 40 nm; 1.7 wt. % Tripropylene glycol; and 89 wt. % water.

The nanoparticle based fluid saturant helps to further reduce the flammability of the fabric by reducing the overall amount of organics that are present in the fabric.

The fire retardant coating layer comprises a polyurethane film having a combination of flame retardant compounds incorporated therein. The fire retardant coating layer typically includes a thermally degradable aliphatic or aromatic halogen containing compound; an antimony oxide (e.g., $Sb_2O_3$, $Sb_2O_5$) or barium metaborate monohydrate; and a metal hydroxide or mineral hydride. The composition from which the fire retardant coating 14 is formed can be prepared by blending or compounding one or more polyurethane polymers with a thermally degradable aliphatic or aromatic halogen containing compound; antimony oxide or; and a metal hydroxide or mineral hydride in the presence of a solvent.

Suitable aliphatic or aromatic halogen compounds that can be used in the practice of the invention include decabromodiphenyl ether and ethylene-bis-tetrabromophthalimide. During combustion, the halogen containing compounds thermally degrade to yield halogen radicals that react with hydrogen and hydroxide ions found in the flame. The resulting gases from these reactions are more stable and do not support oxidation. Generally, the aliphatic or aromatic halogen compound is present in the coating in an amount that is from about 10 to 30 wt. %, based on the total weight of the coating, and in particular from about 15 to 30 wt. %, and more particularly from about 20 to 25 wt. %.

The antimony oxide and barium metaborate monohydrate are generally believed to have a synergistic effect in combination with the aromatic halogen compound to help retard propagation of the fire. When present, the amount of antimony oxide in the coating is typically between about 0.5 to 5 wt. %, based on the total weight of the coating. More typically, the amount of antimony oxide in the coating is typically between about 1 to 3 wt. %. The amount of barium metaborate monohydrate in the coating is typically between about 2 to 10 wt. %, and more typically between about 4 to 6 wt. %, based on the total weight of the coating.

The presence of a metal hydroxide or mineral hydride in the polyurethane film helps to reduce the heat generated by ignition of the protective fabric. Generally, the metal hydroxide or mineral hydride degrades by an endothermic process in which the removes thermal heat from the combustion region, which in turn helps to stabilize the afforded gasses from the halogens. As a result, melting of the nylon or polyester fabric substrate can be reduced or prevented. Suitable metal hydroxides that may be used in the practice of the invention include aluminum hydroxide, magnesium hydroxide, aluminum trihydroxide, and hydroxycarbonate, and the like. Generally, the metal hydroxide or mineral hydride is present in the coating in an amount that is from about 1 to 20 wt. %, based on the total weight of the coating, and in particular from about 3 to 10 wt. %, and more particularly from about 4 to 6 wt. %.

The fire retardant coating layer can also include additional components including pigments, stabilizers, dispersants, rheology modifiers, matting agents, crosslinkers, coating lubricants, fungicides, and the like. In one embodiment, the fire retardant coating layer includes trimethoxymethylmelamine.

The fire retardant coating layer can be applied to the fabric substrate as a fluid having a viscosity ranging from about 10,000 to 50,000 cps. In the case of relatively light weight fabrics (e.g., having a basis weight less than about 200 g/m$^2$) it is generally desirable for the fluid from which the fire retardant coating layer is formed to have a viscosity ranging from about 10,000 to 15,000 cps. For heavier weight fabrics it may be desirable for the fluid to have a viscosity greater than about 15,000 cps, such as viscosity in excess of about 20,000 cps. Suitable solvents that can be used in the practice of the invention include toluene, xylene, isopropyl alcohol (IPA), methyl ethyl ketone (MEK), and dimethylformamide (DMF).

In one particular embodiment, the flame retardant coating layer comprises from about 65 to 80 wt. % polyurethane in solvent, about 20 to 25 wt. % of decabromodiphenyl ether or ethylene-bis-tetrabromophthalimide; about 1 to 3 wt. % antimony trioxide or about 4 to 6 wt. % barium metaborate monohydrate; and about 4 to 6 wt. % aluminum hydroxide, based on the total weight of the dried coating.

The fire retardant coating layer can be prepared by mixing the halogenated flame retardant, antimony hydroxide or barium metaborate monohydrate, metal hydroxide components, and solvent in a mix tank to produce a coating material having a desired viscosity. The fire retardant layer may then be applied to the surface of the fabric substrate. In one embodiment, the fire retardant coating layer is applied by via a knife blade over a table coater. The coating may be applied in a single or multiple coats. The coating is then dried and cured. The fire retardant layer can be applied before or after the fluid saturant has been applied to the fabric substrate.

Generally, the thickness of the fire retardant coating layer ranges from about 0.5 to 3 mils, and in particular, from about 1 to 2 mils. Desirably, the fire retardant coating layer is applied to the fabric at a minimum basis weight of about 10 g/m$^2$, and more desirably, from about 13 to 101 g/m$^2$ (about 0.4 to 3.0 oz/yd$^2$ dry weight). In one embodiment, the polyurethane coating has a basis weight ranging from about 50 to 100 g/m$^2$.

In applications where breathability is desirable, the fire retardant coating layer comprises a breathable polyurethane film. In breathable applications, the polyurethane film is substantially impervious to liquids while at the same time permitting the transmission of moisture vapor. For example, the fire retardant coating layer can have a moisture vapor transmission rate (MVTR) of at least 200 g/m$^2$/day. Moisture Vapor Transmission Rate (MVTR) is determined by ASTM E 96, Standard Test Methods for Water Vapor Transmission of Materials; 1996, Procedure B. In one embodiment, the fire retardant coating layer typically has a MVTR that is from about 400 to 1400 g/m$^2$/day, and more typically at from about 600 to 1200 g/m$^2$/day. The fire retardant coating layer may be monolithic or microporous.

The resulting composite fabric has an overall basis weight of from about 3 to 6 oz/sy and a MVTR of at least 600 g/m$^2$/24 hr. at 50% relative humidity and 23° C. (73° F.), and more desirably and MVTR of at least 1200. The fabric also has a hydrostatic head of at least 20 cm. Ideally, the breathable fire resistant fabric has a hydrohead from about 30 to 80 cm, and in particular from about 50 to 75 cm. In one particular embodiment, the fire retardant coating layer has an MVTR of at least about 1200 g/m$^2$/day and a hydrohead of at least about 50 cm.

Advantageously, the fire resistant fabric maintains all of the typical properties desired by the end user with the addition of; self extinguishing, low to no after glow or burning when the ignition source is removed, low to no smoke, short burn time and low total mass consumption, low to no free dripping. The fire resistant fabric also exhibits good durability and in particular is resistant to laundering, abrasion, solvents, water, oils and has little to no odor.

Desirably, the fire resistant fabric has char length in the warp/fill directions that is less than about 6 inches, and more desirably less than about 4 inches, and most desirably less than about 3 inches. In one embodiment, the fire resistant fabric has char length in both the warp/fill directions that is less than about 4.5 inches. In one embodiment, the fabric has less than 5 drips of molten polymer (e.g., nylon or polyester), and in a particularly advantageous embodiment the fire resistant fabric desirably has less than 5 drips, and more desirably 0 drips of molten polymer. Unless otherwise stated, the fire resistant properties of the fabric are measured in accordance with NFPA 701.

In a particularly advantageous embodiment, the fabric substrate comprises nylon to which the flame retardant oligimer of the fluid saturant is covalently bonded via the active proton on the polyamide (nylon). Advantageously, this provides for the fire retardant saturant having a strong adherence to the fabric substrate.

EXAMPLES

In the following examples four different fabric substrates were impregnated with a fire resistant saturant and coated with a fire retardant coating. In Samples 1 and 2, relatively lightweight fire resistant fabrics composed of nylon fibers were prepared, whereas in Samples 3 and 4, the fabric were of a relatively heavy nylon fiber construction.

Sample 1:

RW 84.97, GW 74.50", 74×60;

Warp 2/70/68 FD AJT Core & Effect Nylon 6,6;

Fill #1 20/1 Clear Spandex (Radici) covered with 2/70/48 SD FFT Stretch Nylon 6,6;

Fill #2 2/70/68 FD AJT Core & Effect Nylon 6,6.

Sample 2:

Plain Weave, 89.5×74

Warp 1/70/48 SD FTT Nylon

Fill 2/70/68 FD FTT Nylon

Samples 1 and 2 were impregnated with the following water repellant and flame retardant saturant composition: 17% thiourea formaldehyde adduct, (Flameout N15 manufactured by EMCO); and 1.2% Fluoroalkyl acrylate copolymer, 0.6% tripropylene glycol (Lurotex Adv manufactured by BASF).

Samples 1 and 2 were coated with a fire retardant coating having the following composition: 40% breathable flame retardant polyurethane (Solucote Top FR 767 manufactured by Soluol); 18% aromatic halogenated flame retardant (Decabromodiphenyl ether or ethylene-bis-tetrabromophthalimide manufactured by Dead Seas Bromine Group or Albermarle, respectively); 1.3% Antimony trioxide or 4.4% barium metaborate monohydrate (manufactured by Allcoat or Buckman Laboratories, respectively); 4.6% Aluminum Hydroxide (manufactured by JT Baker); organic or inorganic pigment of any color (manufactured by Allcoat or Shepherd Color); and 36% Toluene.

Sample 3: __500D 46×36;

Sample 4 1000D 28 pick.

Samples 3 and 4 were impregnated with the following water repellant and flame retardant saturant composition: 33% Thiourea formaldehyde adduct, (Flameout N15 manufactured by EMCO); and 1.2% Fluoroalkyl acrylate copolymer, 0.6% tripropylene glycol (Lurotex Adv manufactured by BASF).

Sample 3 was coated with a fire retardant coating having the following composition: 35.7% flame retardant polyurethane (Solucote Base FR 536-40K manufactured by Soluol); 18% aromatic halogenated flame retardant (Decabromodiphenyl ether or ethylene-bis-tetrabromophthalimide manufactured by Dead Seas Bromine Group or Albermarle, respectively); 1.3% Antimony trioxide or 4.4% barium metaborate monohydrate (manufactured by Allcoat or Buckman Laboratories, respectively); 4.6% Aluminum Hydroxide (manufactured by JT Baker); organic or inorganic pigment of any color (manufactured by Allcoat or Shepherd Color); 36% Toluene.

The saturant compositions were prepared by mixing the components together to form a homogeneous fluid. The fluid is then pumped into an application tank. The fluid is applied to the fabric by continuously feeding the fabric through the fluid. The fabric absorbs excess fluid which is pressed out by feeding the fabric through two rollers. The exiting fabric maintains approximately 30% by weight of the fluid. The fluid saturated fabric is then dried in an oven temperature at about 350° F. and the linear velocity of the fabric is typically 25 to 35 yards per minute.

The fire resistant coating is prepared by charging the polyurethane resin to a mix tank and stirring at ambient temperatures. Following the polyurethane charge, the aromatic halogenated flame retardant, antimony trioxide, aluminum hydroxide and any pigments are charged and mixed yielding a homogenous coating. In Samples 1 and 2, the coating had a viscosity of about 10,000 cps, and in Samples 3 and 4 the coating had a viscosity of about 20,000 cps.

The coating is applied to the fabric via a knife over table coater. The coating may be applied in one coat or several coats depending on the desired add on weight. The fabric and the coating are dried and cured after the coating is applied. The coating was dried in the oven at a temperature of 3500 F. For the light weight products such as in Samples 1 and 2, the add-on weight is approximately ¾ oz per square yard of fabric dry weight. For the heavy weight fabric of Samples 3 and 4 the add-on weight may be as up to about 2 oz per square yard dry weight.

Fire Resistant Properties:

In Table 1 below, the fire resistant properties of Samples 1-4 are illustrated. The fire resistant properties of the fabric are measured in accordance with NFPA 701.

TABLE 1

Exemplary Fire Resistant Properties

| Sample | After Flame Warp/Fill | Char Length Warp/Fill 12 inches = completely burn | After Glow Warp/Fill | Drips Warp/Fill |
|---|---|---|---|---|
| Sample 1 without FR System | Average of 5 measurements 39.7/43.4 sec. | Average of 5 measurements 12/12 inches | Average of 5 measurements 0/0 | Average of 5 measurements 5.4/7.8 |
| Sample 1 with FR system | Average of 5 measurements 0.0/0.0 | Average of 5 measurements 2.58/4.13inches | Average of 5 measurements 0/0 | Average of 5 measurements 0.0/0.0 |
| Sample 2 without FR System | Average of 5 measurements 45.4/46.2 sec. | Average of 5 measurements 12/12 inches | Average of 5 measurements 0/0 | Average of 5 measurements 15.6/11.6 |
| Sample 2 with FR System | Average of 5 measurements 0.0/0.0 sec. | Average of 5 measurements 3.4/2.9 inches | Average of 5 measurements 0/0 | Average of 5 measurements 0.0/0.0 |
| Sample 3 without FR System | Average of 5 measurements 45.8/52.4 sec. | Average of 5 measurements 12/12 inches | Average of 5 measurements 0/0 | Average of 5 measurements 10/18 |
| Sample 3 with FR System | Average of 5 measurements 0.0/0.0 sec. | Average of 5 measurements 1.8/1.9 inches | Average of 5 measurements 0/0 | Average of 5 measurements 0.6/0.0 |
| Sample 4 without FR System | Average of 5 measurements 20.4/51.8 sec. | Average of 5 measurements 12/12 inches | Average of 5 measurements 0/0 | Average of 5 measurements 19/21 |
| Sample 4 with FR System | Average of 5 measurements 0.0/0.0 sec | Average of 5 measurements 2.1/2.9 inches | Average of 5 measurements 0/0 | Average of 5 measurements 1/2.8 |

Barrier Properties

TABLE 2

Barrier Properties

| Sample | Hydro Head | Water Repellency tested after laundering 3X | Oil Repellency | MVTR $g/m^2/24$ hours |
|---|---|---|---|---|
| Sample 1 | Average of 5 measurements 33.4 cm | 100/100/100 | Pass # 5 | 876 |
| Sample 2 | Average of 5 measurements 60+ cm | 100/100/100 | Pass # 5 | 873 |
| Sample 3 | Average of 5 measurements 50+ inches | 100/100/100 | Pass # 5 | Not applicable |
| Sample 4 | Average of 5 measurements 50+ cm | 100/100/100 | Pass # 5 | Not applicable |

Table 3 below, illustrates some exemplary properties that are desirable for fabrics that are in accordance with the invention.

TABLE 3

Exemplary Fabric Properties.

| Test description | Method | Sample 1 | Sample 2 | Sample 3 500D | Sample 4 1000D |
|---|---|---|---|---|---|
| Resistance to Organic Liquids | 4.6.5.1 | No wet | No wet | No wet | No wet |
| Hydrostatic Resistance | 4.6.3 | No leaking below 30 cm | No leaking below 30 cm | No leaking below 30 cm | No leaking below 30 cm |
| Blocking | 4.6.2 | Max rating of 2 | | | |
| Breaking Strength Warp | ASTM D 5034 | 165 lbs. min, objective 145 lbs. | | 360 min | 500 min |
| Breaking Strength fill | | 130 lbs. min | | 270 min | 300 min |
| Moisture Vapor Transmission | ASTM E 96 $g/m^2/24$ h (B) | 600 min, 1200 objective | | | |
| Spray Rating | 4.6.4.1 | 100, 100, 90 | 100, 100, 90 | 100, 100, 90 | 100, 100, 90 |
| Spray Rating 5 launderings | 4.6.4.1 & 4.6.4.2 | 100, 90, 90 | 100, 90, 90 | 90, 90, 90 | |
| Dimensional stability, warp | AATCC 96 opt. 1 | 5.5% max | | 3.0 max | |
| Dimensional stability, fill | AATCC 96 opt. 1 | 5.0% max | | 2.0 max | |
| Dynamic absorption | AATCC 70 | 4% max, objective 25% | 5% max | 20% max | |
| Elongation fill | ASTM D 5034 | 80-100% objective, 70-120% threshold | | | |
| Elongation warp | ASTM D 5034 | 45-60% objective, 40-80% threshold | | | |
| Air Permeability | ASTM D 737 | 5.0 cfm max | | | |
| Colorfastness to crocking | AATCC-8 | Better than 3-4 | | 3-4 | 3.5 |
| Colorfastness to laundering | 4.6.9.1 | Equal to or better than 1 | | | |
| Colorfastness to light | 4.6.9.1.2 | Equal to or better than 1 | | 3-4 | |
| Stiffness @ 32 F | ASTM D 747 | 0.001 in/lbs max | | 0.034 lbs max force | |
| Stiffness @ 70 F | ASTM D 747 | 0.001 in/lbs max | | | |
| Tearing strength fill | ASTM D 1424 | 8.0 lbs min | | | |
| Tearing strength warp | ASTM D 1424 | 8.0 lbs min. | | | |
| Weight | ASTM D 3776 | 5.5 oz.sq yd max | | 7.5-8.5 oz/sq yd | 11-12 oz/sq yd |

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A fire resistant fabric that is resistant to water and permeable to moisture vapor, comprising:

a woven fabric substrate formed of polyester or nylons fibers;

a fluid saturant impregnating the fabric and covering the surfaces of the fibers, the fluid saturant comprising a fire resistant oligimer and an oil and water repellent composition; and a layer of fire resistant polyurethane coating covering at least one surface of the fabric substrate, the polyurethane coating comprising polyurethane; a thermally degradable aromatic halogen containing compound; an antimony oxide; and a metal hydroxide, wherein the fabric has a moisture vapor transmission rate of at least 600 $g/m^2$/day and a hydrohead of at least 30 cm.

2. The fire resistant fabric of claim 1, wherein the oil and a water repellent composition is selected from the group consisting of fluorochemicals and polysiloxanes.

3. The fire resistant fabric of claim 1, wherein the aromatic halogen compound is selected from the group consisting of decabromodiphenyl ether and ethylene-bis-tetrabromophthalimide.

4. The fire resistant fabric of claim 1, wherein the metal hydroxide comprises one or more of alumina trihydrate, aluminum hydroxide, magnesium hydroxide, and combinations thereof.

5. The fire resistant fabric of claim 1, wherein the fabric substrate comprises nylon to which the polyurethane coating is attached via covalently bonding.

6. The fire resistant fabric of claim 1, wherein the polyurethane coating comprises:

about 35 to 40 wt. % polyurethane;

about 15 to 20 wt. % of decabromodiphenyl ether or ethylene-bis-tetrabromophthalimide;

about 1 to 2 wt. % antimonyoxide; and about 3 to 10 wt. % aluminum hydroxide.

7. The fire resistant fabric of claim 1, wherein the fluid saturant comprises about 17% thiourea formaldehyde and about 1.2% fluoroalkyl acrylate copolymer.

8. The fire resistant fabric of claim 1, wherein the polyurethane coating has a basis weight of at least 10 $g/m^2$.

9. The fire resistant fabric of claim 1, wherein the fabric has a moisture vapor transmission rate of at least 1200 $g/m^2$/day and a hydrohead of at least 50 cm.

10. A fire resistant fabric comprising:

a woven fabric substrate formed of polyester or nylons fibers;

a fluid saturant impregnating the fabric and covering the surfaces of the fibers, the fluid saturant comprising a fluoroalkyl acrylate copolymer and thiourea formaldehyde; and a layer of fire resistant polyurethane coating covering at least one surface of the fabric substrate, the polyurethane coating comprising polyurethane; a thermally degradable aromatic halogen containing compound; barium metaborate monohydrate; and a metal hydroxide.

11. The fabric of claim 10, wherein the polyurethane coating comprises:

about 35 to 40 wt. % polyurethane;

about 15 to 20 wt. % of decabromodiphenyl ether or ethylene-bis-tetrabromophthalimide;

about 4 to 5 wt. % barium metaborate monohydrate; and about 4 to 5 wt. % aluminum hydroxide.

12. The fabric of claim 10, wherein fabric has char length in a warp and a fill direction that is less than about 4.5 inches, and exhibits less than about 5 drips of molten nylon or polyester material as measured in accordance with NFPA 701.

13. The fabric of claim 10, wherein the thickness of the polyurethane coating is from about 1 to 2 mils.

14. The fabric of claim 10, wherein the fluid saturant comprises about 17% thiourea formaldehyde and about 1.2% fluoroalkyl acrylate copolymer.

15. The fabric of claim 10, wherein the fabric has a moisture vapor transmission rate of at least 600 $g/m^2$/day and a hydrohead of at least 30 cm.

16. A method of forming a flame-retardant substrate comprising steps of:

providing a piece of woven fabric composed of nylon or polyester fibers;

impregnating the fabric with a composition comprising a fire resistant oligimer and an oil and water repellent composition;

applying heat to the fabric at a rate sufficient to cure the composition; and coating at least one surface of the fabric with a polyurethane layer comprising polyurethane; a thermally degradable aromatic halogen containing compound; barium metaborate monohydrate or antimony oxide; and a metal hydroxide.

17. The method of claim 16, further comprising the step of adding the composition comprising a fire resistant polymer and an oil and water repellent composition at a weight of about 0.05 to 1 ounces per square yard of material.

18. The method of claim 16, wherein the polyurethane coating comprises:

about 35 to 40 wt. % polyurethane;

about 15 to 20 wt. % of decabromodiphenyl ether or ethylene-bis-tetrabromophthalimide;

about 1 to 3 wt. % barium metaborate monohydrate; and about 4 to 5 wt. % aluminum hydroxide.

19. The method of claim 16, wherein the composition comprising a fire resistant polymer and an oil and water repellent composition comprises a fluoroalkyl acrylate copolymer and thiourea formaldehyde.

20. The method of claim 16, the fabric has a moisture vapor transmission rate of at least 600 $g/m^2$/day and a hydrohead of at least 30 cm.

* * * * *